US006756096B2

(12) United States Patent
Harding

(10) Patent No.: US 6,756,096 B2
(45) Date of Patent: Jun. 29, 2004

(54) METHOD OF LOADING A CUSHIONING CONVERSION MACHINE AND SHEET STOCK MATERIAL SUPPLY USEFUL THEREIN

(75) Inventor: Joseph J. Harding, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 09/992,536

(22) Filed: Nov. 19, 2001

(65) Prior Publication Data

US 2002/0100539 A1 Aug. 1, 2002

Related U.S. Application Data

(60) Provisional application No. 60/249,698, filed on Nov. 17, 2000.

(51) Int. Cl.[7] ..... B31F 1/10

(52) U.S. Cl. ..... 428/40.1; 428/42.1; 428/42.2; 428/42.3; 428/43; 428/192; 428/194; 428/906

(58) Field of Search ..... 428/40.1, 42.1, 428/42.2, 42.3, 192, 194, 906, 43

(56) References Cited

U.S. PATENT DOCUMENTS 3,752,304 A * 8/1973 Alef ..... 118/505
4,889,759 A * 12/1989 Yamazaki ..... 428/40.1
5,323,981 A * 6/1994 Dionne ..... 242/58.5
5,370,916 A * 12/1994 Olsen ..... 428/40
5,589,013 A * 12/1996 Stepanek ..... 428/42.1
5,755,656 A 5/1998 Beierlorzer

FOREIGN PATENT DOCUMENTS

WO WO 96 40496 12/1996
WO WO 98 04402 2/1998

* cited by examiner

*Primary Examiner*—Nasser Ahmad
(74) *Attorney, Agent, or Firm*—Renner, Otto, Boisselle & Sklar, LLP

(57) ABSTRACT

A supply of sheet stock material for use in a cushioning conversion machine is disclosed. The supply of stock material includes at least one ply of sheet stock material rolled or folded into a compact configuration such as a roll of wound stock material or a stack of fan-folded stock material. The ply has disposed on a leading or trailing end thereof, a pressure sensitive adhesive layer and a removable release liner covering the pressure sensitive adhesive layer. When a supply of sheet stock material is almost spent, a succeeding supply of stock material may be spliced to the almost spent supply by removing the release liner to expose the adhesive and then applying the leading or trailing end, having the adhesive thereon, to a trailing end of the almost spent supply of stock material or leading end of the succeeding supply of stock material.

15 Claims, 12 Drawing Sheets

METHOD OF LOADING A CUSHIONING CONVERSION MACHINE AND SHEET STOCK MATERIAL SUPPLY USEFUL THEREIN

RELATED APPLICATION DATA

This application claims priority benefit under 35 U.S.C. 119(e) of U.S. Provisional Application No. 60/249,698, entitled "METHOD OF LOADING A CUSHIONING CONVERSION MACHINE AND SHEET STOCK MATERIAL SUPPLY USEFUL THEREIN, " filed Nov. 17, 2000.

FIELD OF THE INVENTION

The present invention relates to machines for converting sheet stock material into a dunnage product and, more particularly, to a method and stock material supply which greatly facilitates splicing of a succeeding supply of stock material to an almost spent supply of stock material.

BACKGROUND

Cushioning conversion machines convert sheet stock material from a supply thereof into a cushioning dunnage product. The sheet stock material is usually supplied in the form of a roll from which the sheet stock material is payed off for conversion by the machine into the dunnage product. When the roll is spent, a new roll is loaded in place of the spent rolland the leading end of the new roll is inserted into the machine. One way of accomplishing this is to splice the leading end of the new roll to the trailing end of an almost spent roll. When the machine is once again operated, the trailing end of the almost spent roll will pull the leading end of the new roll through the machine.

Two techniques heretofore have been used to splice a succeeding supply of stock material to an almost spent supply of stock material. One way was to use several strips of tape to attach a leading end of the succeeding supply of stock material to a trailing end of the almost spent supply of stock material. To facilitate splicing, some conversion machines were provided with a splicing plate on which the trailing end is held while the leading end is spliced thereto. Another way by which splicing has been accomplished was by spraying a liquid adhesive on the trailing end of the almost spent supply and then pressing the leading end of the succeeding supply to the adhesive covered trailing end. The adhesive functions to bond the trailing end and leading end together.

While the above methods of splicing have proven to be feasible, they are not without drawbacks. For example, if the almost spent and succeeding supplies of stock material are to be spliced by taping then the machine operator must have a supply of adhesive tape handy. Otherwise, delays in productivity may ensue. Also, the prior art taping process was somewhat tedious, particularly when multi-ply stock rolls were used as normally was the case. Additionally, if incorrectly applied, the tape may become dislodged and jam the machine or otherwise affect the converting of the stock material.

In regard to the spray adhesive, the adhesive may be oversprayed on the stock material or on parts within or in close proximity to the conversion machine. If the adhesive is sprayed on unintended areas of the stock material then the stock material may jam the conversion machine or otherwise deleteriously affect the quality of the dunnage product. Overspray on parts of the machine may affect the operation of those parts, in particular, if the parts require movement.

The inventor of the present invention appreciated a need for a supply of stock material and a means for splicing the same which would solve the above problems.

SUMMARY

The present invention provides an improved splicing method and supply of sheet stock material which simplifies splicing a succeeding supply of stock material to an almost spent supply of stock material. According to the present invention, a supply of sheet stock material includes at least one ply of sheet stock material rolled or folded into a compact configuration, such as a roll of wound material or a stack of fan-folded material. The ply of stock material has disposed on a leading or trailing end thereof, a pressure sensitive adhesive layer and a removable release liner covering the pressure sensitive adhesive layer.

According to an aspect of the invention, there is provided a method of converting sheet stock material into a cushioning dunnage product, comprising the steps of operating a cushioning conversion machine to produce one or more dunnage pads from a supply of sheet stock material until the supply of sheet stock material is almost spent, removing a release liner to expose a pressure sensitive adhesive layer on a leading end of a succeeding supply of sheet stock material or on the trailing end of the almost spent supply of stock material, applying the leading end of the succeeding supply of stock material to the trailing end of the almost spent supply of stock material such that the pressure sensitive adhesive layer bonds the ends together, and operating the cushioning conversion machine to produce one or more additional pads.

In an embodiment of the invention, the step of removing the release liner includes removing the leading end of the succeeding supply of stock material and the pressure sensitive adhesive thereon from an adjacent layer of the succeeding supply of stock material or removing the trailing end of the almost spent supply of stock material and the pressure sensitive adhesive thereon from an adjacent layer of the almost spent supply of stock material. The step of removing the release liner may include removing a paper strip release liner from the leading end of the succeeding supply of stock material or from the trailing end of the almost spent supply of stock material.

In an embodiment of the invention, the leading end of the succeeding supply of stock material is placed over the trailing end of the almost spent supply of stock material. Alternatively, the trailing end of the almost spent supply of stock material may be placed over the leading end of the succeeding supply of stock material. In the case of a multi ply stock material, the step of removing the release liner and the step of applying the leading end to the trailing end is repeated for each ply.

According to another aspect of the invention, there is provided a supply of sheet stock material for use in a cushioning conversion machine. The supply of stock material includes at least one ply of sheet stock material rolled or folded into a compact configuration. The ply of sheet stock material has on a leading or trailing end thereof a pressure sensitive adhesive layer and a removable release liner covering the pressure sensitive adhesive layer.

In a preferred embodiment of the invention, the removable release liner comprises an adjacent layer of the sheet stock material. The adjacent portion may include on its surface facing the adhesive layer a surface treatment for permitting removal of the adhesive layer from the adjacent portion. The pressure sensitive adhesive layer and the release liner may extend substantially across the width of the ply of sheet stock material, although the adhesive layer and liner may be narrower in width than the stock material to provide tolerance in applying the adhesive layer.

In an embodiment of the invention, the pressure sensitive adhesive layer may form a plurality of adhesive layer portions. The adhesive layer portions may, for example, be transversely spaced across the width of the ply of sheet stock material to form a discontinuous strip of adhesive that extends across the width of the sheet stock material. A single release liner may be provided to cover the multiple adhesive layer portions so that, when released, it exposes all of the adhesive layer portions simultaneously. Alternatively, multiple release liners may be used to cover the respective multiple adhesive layer portions, in which case the release liners are independently released.

The pressure sensitive adhesive layer may be disposed on the outer or inner surface of the leading or trailing end of the ply of sheet stock material. In a preferred embodiment of the invention, multiple plies of stock material each have a pressure sensitive adhesive layer on a leading or trailing end thereof and respective release liners covering the same. The trailing or leading edges of the plies of sheet stock material may be coterminous or longitudinally offset from one another. The trailing or leading edges of the pressure sensitive adhesive layer may also, or alternatively be longitudinally offset from one another. In an embodiment, the trailing or leading edges of the pressure sensitive adhesive layer may be longitudinally offset from trailing or leading edges of the plies.

In an embodiment of the invention, the pressure sensitive adhesive layer forms a strip. The strip is attached to the ply on a leading or trailing end thereof. The strip enables the pressure sensitive adhesive layer feature to be retrofitted with an existing supply of stock material.

In an embodiment of the invention, the pressure sensitive adhesive layer comprises a reduced strength adhesive, enabling a release liner to be cleanly and easily removed from the adhesive layer to expose the adhesive layer, which exposed adhesive layer can then be removably adhered to the sheet stock material. Also, the adhesive layer may include separate adhesive layer portions including, for example, a permanent bond type adhesive layer where it is desired to keep the adhesive layer intact once spliced, and a reduced strength adhesive layer where it is desired to be able to easily remove and/or reposition the stock material.

The foregoing and other features of the invention are hereinafter fully described and particularly pointed out in the claims, the following description and the annexed drawings setting forth in detail plural illustrative embodiments of the invention, such being indicative, however, of but a few of the various ways in which the principles of the invention may be employed.

DETAILED DESCRIPTION

Figure 1:
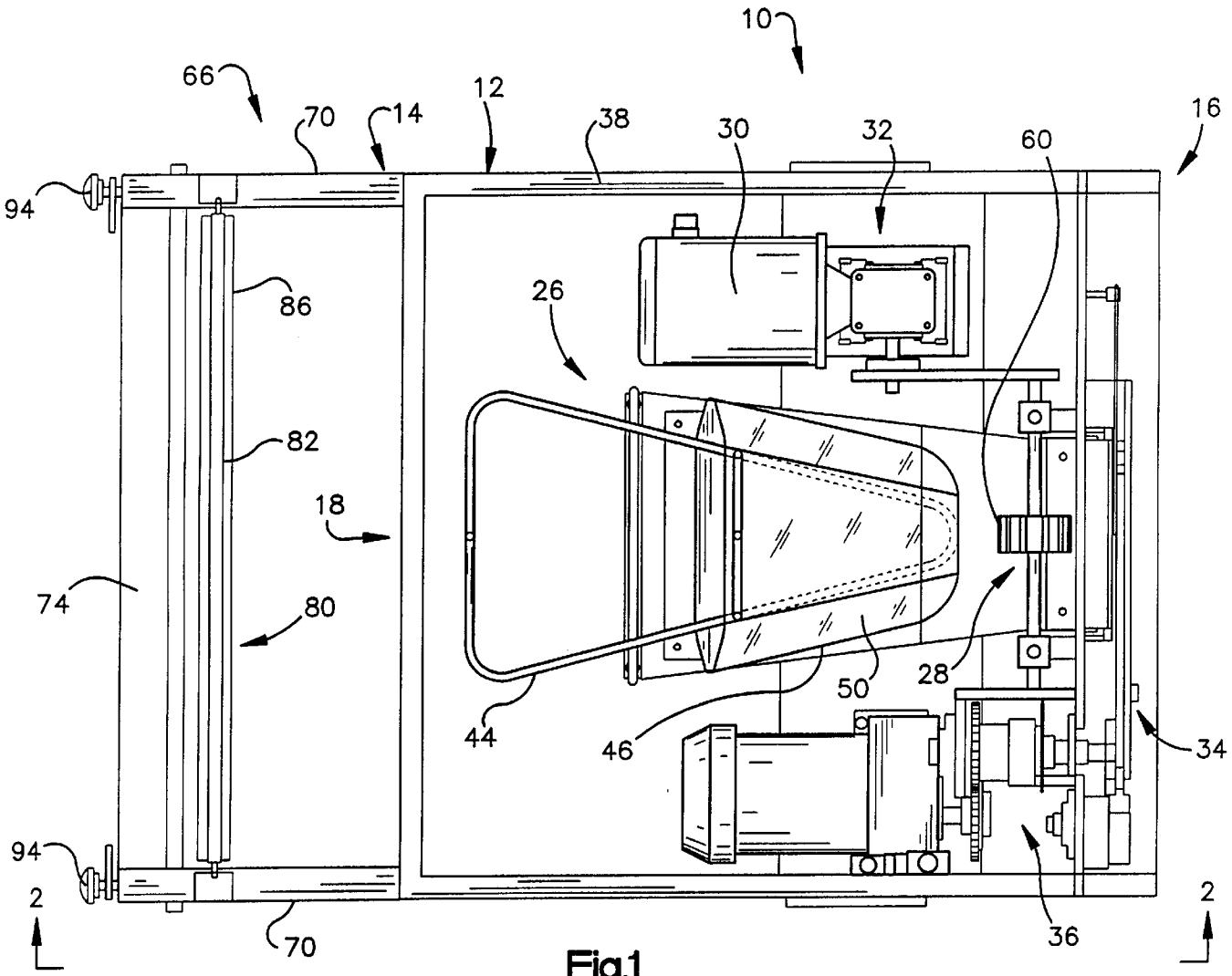
FIG. 1 is a top plan view of a cushioning conversion machine.
Figure 2:
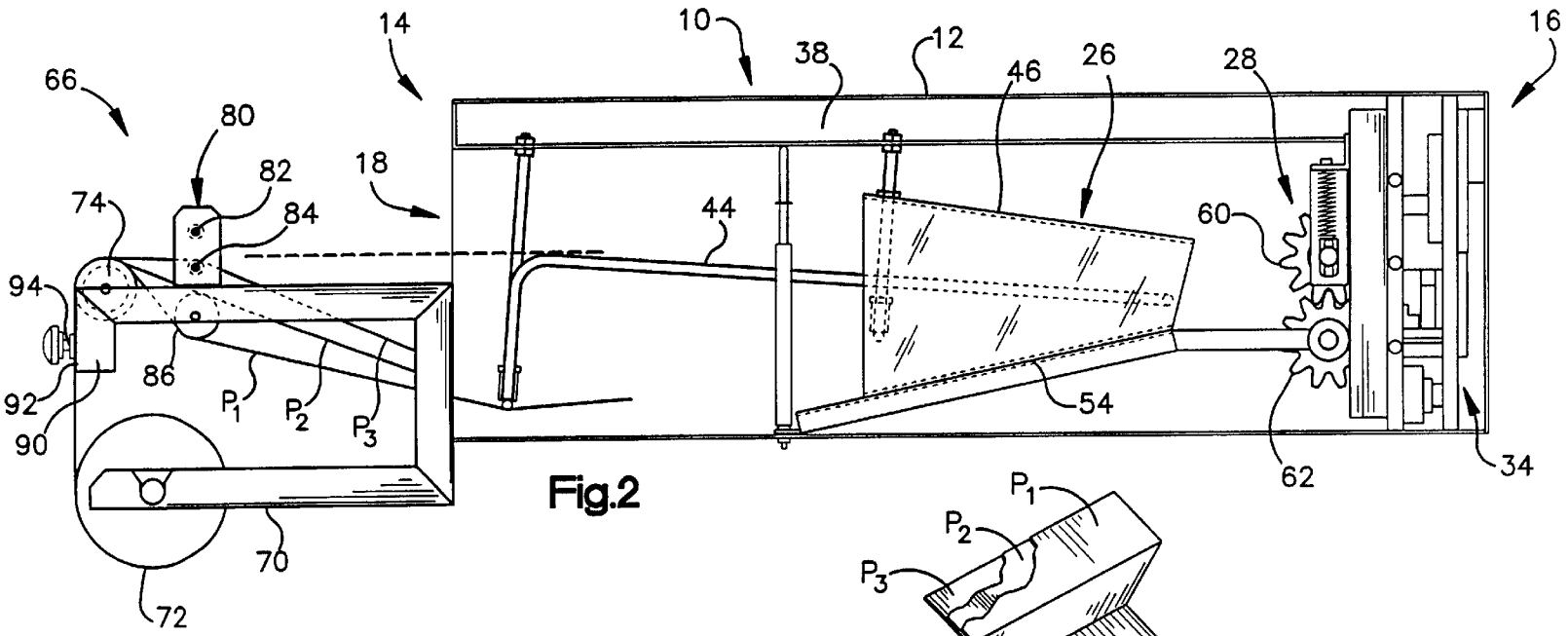
FIG. 2 is a side elevational view of the cushioning conversion machine of FIG. 1, the machine being shown in a horizontal manner, loaded with stock material, and with an outer housing side wall removed for clarity of illustration.
Figure 3:
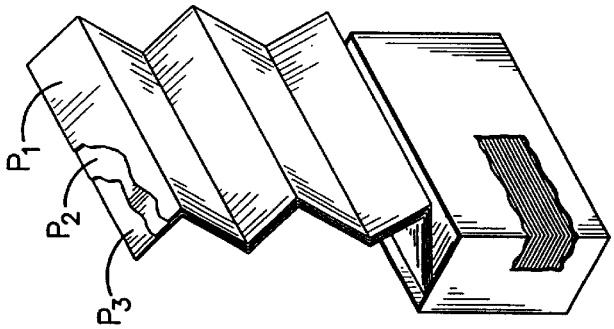
FIG. 3 is a perspective view of a supply of stock material in fan-folded form.

Referring now to the drawings in detail and initially to FIGS. 1 through 3, a cushioning conversion machine is designated generally by reference number 10. As is further described below, the cushioning conversion machine 10 converts a sheet stock material from a supply thereof into a cushioning dunnage product. According to the present invention, the supply of stock material is in a compact configuration, such as a roll of wound stock material (FIGS. 1 and 2) or a stack of fan-folded stock material (FIG. 3), and includes a pressure sensitive adhesive layer enabling an almost spent supply of the stock material to be spliced to a next or succeeding supply of stock material in a relatively simple and quick manner.

Referring initially then to FIGS. 1 through 3, the conversion machine 10 includes a conversion assembly, indicated generally at 12, having an upstream end 14 and a downstream end 16. The stock material enters the conversion assembly 12 through an opening 18 at the upstream end thereof for passage through the conversion assembly 12 where it is converted into a strip of dunnage that exits from the downstream end 16 of the conversion assembly 12.

The conversion assembly 12 includes a former or forming assembly 26 and a feeding/connecting assembly 28 powered (energized) by a feed motor 30, for example an electric motor, through a motion transfer assembly 32. Downstream of the feeding/connecting assembly, there is provided a severing assembly 34 (for example a cutting assembly) powered by suitable means, such as the illustrated motor and motion transfer assembly 36. The forming assembly 26, feeding/connecting assembly 28 and severing assembly 34 are mounted to and/or in a housing 38 in a well-known manner. The operation of the conversion machine 10 may be controlled by a controller, also in a well-known manner. As will be apparent, other types of severing assemblies may be employed, such as those disclosed in commonly owned U.S. Pat. Nos. 4,699,609 and 5,123,889. Also, other types of conversion assemblies may be employed for converting the sheet material to a three-dimensional strip of dunnage that is severed to length by the severing assembly.

The illustrated forming assembly 26 includes a forming member 44, such as a forming frame, and a converging shaping chute 46. The forming assembly 26 causes an inward rolling or folding of the lateral edges of the sheet stock material to form a continuous strip of cushioning having lateral pillow-like portions. The shaping chute 46 includes longitudinally extending, transversely converging side walls 50 which preferably are curved or arcuate in transverse cross-section. As the sheet stock material is passed through the shaping chute 46, the side edges thereof are turned or rolled inwardly towards one another so that the inwardly turned or rolled edges form resilient pillow-like crumpled portions of stock material disposed in lateral abutting relationship as they emerge from the exit end of the shaping chute. The forming member 44 coacts with the shaping chute 46 to ensure proper shaping and forming of the stock material, the forming member being operative to guide the central portion of the stock material along the bottom wall 54 of the shaping chute 46 for controlled inward rolling or folding of the side edge portions of the stock material. The forming member 44 projects rearwardly (upstream) of the entry end of the shaping chute for proper guiding of the stock material into the shaping chute. The forming member 44 also extends into the shaping chute with its forwardmost end disposed relatively close to the underlying bottom wall 54 of the shaping chute adjacent the exit end of the shaping chute, as shown.

The illustrated feeding/connecting assembly 28 includes a pair of cooperating and opposed gears or gear-like members 60 and 62. The gears 60 and 62 of the feeding/connecting assembly 28 perform two functions in the operation of the machine 10. One function is a "feeding" function, with the gears pulling the stock material from the supply of stock material and then through the forming assembly 26. The stock material is then discharged by the feeding/connecting assembly 28 to the severing assembly 34. The second function preferably performed by the feeding/connecting assembly 28 is a connecting function. Specifically, the feeding/connecting assembly 28 connects the continuous strip by the two opposing gears 60 and 62 coining the formed stock material along a central band to form a connected strip of cushioning. Other mechanisms may be employed to "connect" the strip, i.e., to operate on the strip in such a manner that it will retain its cushioning properties as opposed to reverting to the original flat form of the stock material. Known connecting mechanisms include mechanisms that crease the stock material to enable the stock material to hold its three-dimensional shape.

The connected strip travels downstream from the feeding/connecting assembly 28 to the severing assembly 34 which severs, for example by cutting, the strip into a section of a desired length. The severed section then may travel through a post-cutting guide assembly such as in the manner described in commonly owned U.S. Pat. No. 5,123,889, which includes a converging portion and rectangular tunnel portion. The coined or otherwise connected strip then emerges from the post-cutting guide assembly where an operator may remove the coined strip from the machine 10.

Referring now to the upstream end 14 of the conversion machine 10, the stock material supplied thereto may be in the form of a roll of wound stock material (FIGS. 1 and 2) or a stack of fan-folded stock material (FIG. 3). In particular, the stock material includes one or more plies of sheet material, each ply generally being made of paper, for example of, thirty-pound weight Kraft paper. Also, one or more of the plies may be made of another type of sheet material and/or paper, such as printed paper, bleached paper, fifty-pound kraft paper, or combinations thereof. Additionally, although the stock material shown in FIGS. 1 through 3 comprises three plies $P_1$, $P_2$, $P_3$ of sheet material, other multi-ply arrangements, such as two-ply, four-ply, and eight ply arrangements, are possible with, and contemplated by, the present invention.

The stock material is supplied to the conversion machine 10 by a stock supply assembly 66. The illustrated stock supply assembly includes a pair of C-shaped laterally spaced apart mounting brackets 70 secured to the conversion assembly 12. When rolled stock material is used with the conversion machine 10, the lower legs of the brackets 70 have journalled between the ends thereof a stock supply roll 72. When fan-folded stock material (FIG. 3) is used with the machine 10, the lower legs are not necessary. The upper legs of the brackets 70 have journalled between the ends thereof a constant entry roller 74 that provides a non-varying point of entry for the sheet stock material from the supply of stock material. The brackets 70 also support therebetween a separating device 80 which receives the sheet stock material from the constant entry roller 74 and separates the multiple plies $P_1$, $P_2$, $P_3$ from one another via spaced apart and transversely extending separator members 82, 84, 86 prior to passing beneath the forming member 44 and into the shaping chute 46. For further details concerning the constant entry roller 72 and the separating device 80, reference may be had to U.S. patent application Ser. No. 09/229,459, which is also assigned to the assignee of the present invention.

As is most clearly shown in FIG. 2, the upper arms of the brackets 70 terminate at depending arms 90. The depending arms 90 support therebetween a transversely extending splicing plate 92 over which the stock material passes as it is drawn by the feeding/connecting assembly 28. The depending arms 90 have paper clamps 94 mounted thereto on opposite sides of the path of the stock material. One type of paper clamps that can be utilized includes clamps that are spring biased against an adjacent clamping surface and are rotatable from a position clear of the stock material path to a position overlaying the stock material path, such that when released the clamps 94 are operative to hold the stock material to the clamping surface upstream of the splicing plate 92. If desired, small magnets can also be used to perform the clamping function. It should be noted that the terms "upstream" and "downstream" are herein used in relation to the direction of flow of the stock material through the machine 10.

The splicing plate 92 provides a surface along which the ply ends may be spliced. Thus, as is further described below, when the trailing ends of the plies of an almost spent supply of stock material are held, the leading ends of the plies of a succeeding supply of stock material may be spliced to the trailing ends. To detect that a supply of stock material is nearing its depleted or spent state, an end of web detector may be included. For further details concerning the afore described splicing plate, reference may be had to commonly owned U.S. Pat. No. 5,755,656. For further details concerning an alternative configuration of a splicing plate, reference may be had to Ser. No. 60/139,702, which is also assigned to the assignee of the present invention. For further details concerning the end of web detector, reference may be had to U.S. Pat. No. 5,749,821, which is also assigned to the assignee of the present invention.

Referring now to FIGS. 4 through 21, there are shown several embodiments of a supply of stock material and the trailing and/or leading ends thereof in accordance with the present invention. It is noted that while some of the illustrated embodiments are described with reference to a supply of stock material in the form of a wound roll of stock material, the description which follows is also applicable to the aforementioned fan-folded supply of stock material and other forms of supply of stock material.

Figure 4:
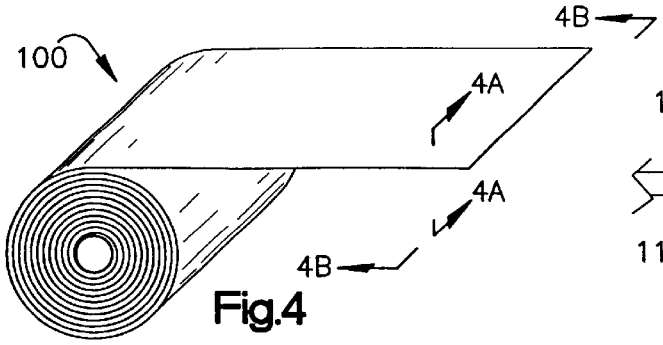
FIG. 4 is a perspective view of a supply of stock material in accordance with an embodiment of the present invention.
Figure 4A:
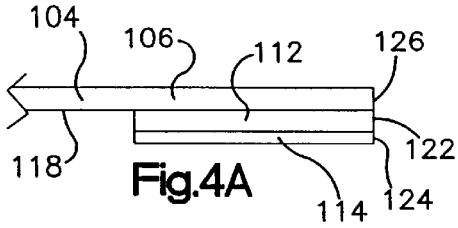
FIG. 4A is a side view of the FIG. 4 supply of stock material taken along the line 4A—4A in FIG. 4.
Figure 4B:
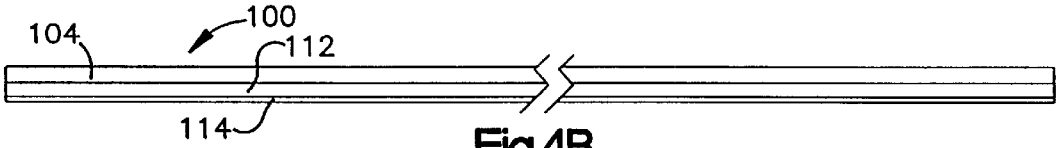
FIG. 4B is an end view of the FIG. 4 supply of stock material taken along the line 4B—4B in FIG. 4.

Referring initially then to FIGS. 4–4B, there is shown a supply roll of stock material 100 including a single ply of sheet material 104. A leading end 106 of the ply of sheet material 104 is provided with a pressure sensitive adhesive layer 112 and a release liner 114, with release liner 114 covering the pressure sensitive adhesive layer 112. An exemplary adhesive layer and release liner can take the form of an adhesive transfer tape having an acrylic adhesive and a paper strip release liner. As is shown in FIG. 4A, the adhesive layer 112 and release liner 114 are attached on the inner surface or underside 118 of the sheet material 104, and leading edges 122 and 124 of the respective adhesive layer 112 and release liner 114 are aligned with a leading edge 126 of the ply of sheet material 104. Also, as is shown in FIG.

4B, the adhesive layer 112 and release liner 114 extend transversely along the length of the ply of material 104. By releasing the liner 114, such as by manually peeling same from the pressure sensitive adhesive layer 112, the leading end 106 of the stock material 104 may be spliced to, or more particularly adhered to, the top, or outer, surface of a trailing end of an almost spent supply of stock material extending from the upstream end of the machine 10.

Figure 5:
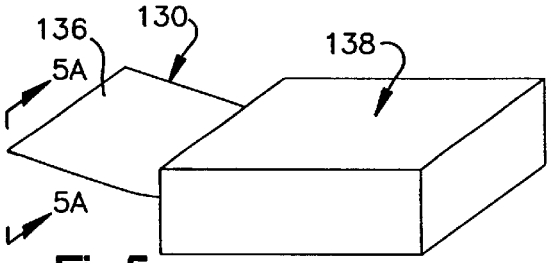
FIG. 5 is a perspective view of a supply of stock material in accordance with an embodiment of the present invention, the supply of stock material being shown in an almost spent state and a trailing end of the stock material being shown at the upstream end of a cushioning conversion machine.
Figure 5A:
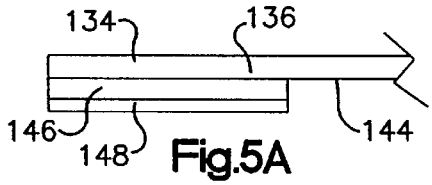
FIG. 5A is a side view of the FIG. 5 supply of stock material taken along the line 5A—5A in FIG. 5.

Referring to FIGS. 5 and 5A, there is shown another embodiment of a supply of stock material 130, the supply of stock material 130 being shown in an almost spent state with the trailing end 134 of a ply of sheet material 136 remaining at the upstream end of the conversion machine 138. The ply of sheet material 136 is provided on the underside or bottom surface 144 of its trailing end 134 a pressure sensitive adhesive layer 146 and a release liner 148 covering the adhesive layer 146. According to this embodiment, by releasing the liner 148 from the adhesive layer 146 the trailing end 134 of the almost spent supply of stock material 130 may be spliced to, or more particularly adhered to the underside of, a leading end of a succeeding supply of stock material.

Figure 6:
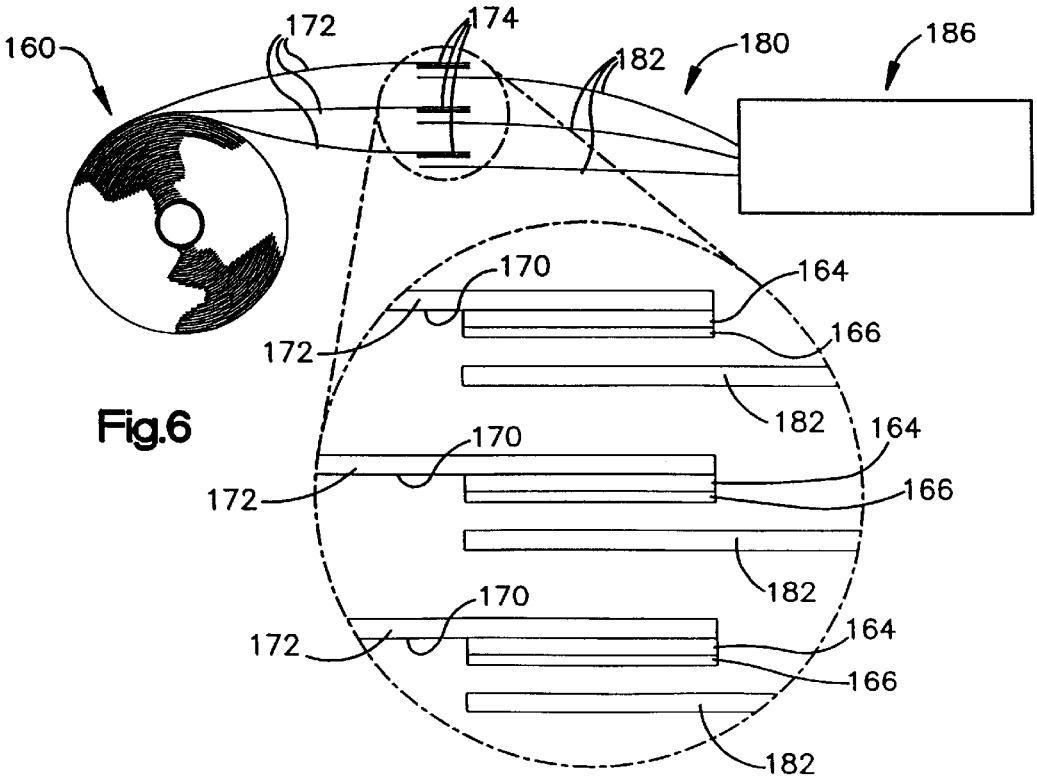
FIG. 6 is a side elevational view of a succeeding supply of stock material and an almost spent supply of stock material in accordance with an embodiment of the present invention.

FIGS. 6–9 show the pressure sensitive adhesive layer and release liner used in a supply of stock material having multiple plies. In FIG. 6, a next or succeeding supply of stock material 160 includes an adhesive layer 164 and a liner 166 that are attached on the underside 170 of each ply 172 at the leading end 174 thereof. The liners 166 enable the plies of sheet material 172 to be stacked one atop of the other in a compact configuration as shown, for example, in the wound roll of stock material 160 in FIG. 6A. The as shown adhesive layer 164 and liners 166 of the respective plies 172 are enlarged to emphasize the overlap thereof. In FIG. 6, the next or succeeding supply of stock material 160 is in a position for splicing with an almost spent or depleted supply of stock material 180, the plies 182 of which are shown at an upstream end of the conversion machine 186. To splice the succeeding supply of stock material 160 to the almost spent supply of stock material 180, the liners 166 are released from the adhesive layers 164 of the respective plies 172 of the succeeding supply of stock material 160 and the adhesive layers 164 are applied to the top, or outer, surfaces of the trailing ends of the plies 182 of the almost spent supply of stock material 180. All of the liners 166 may be released before applying the adhesive layers 164 to the respective trailing ends of the spent supply of stock material 180 or, alternatively, each time a liner 166 is released the respective adhesive layer 164 is applied to the appropriate ply 182 before releasing another liner 166. Preferably the splicing sequence starts with the innermost of the several plies to be joined.

Figure 7:
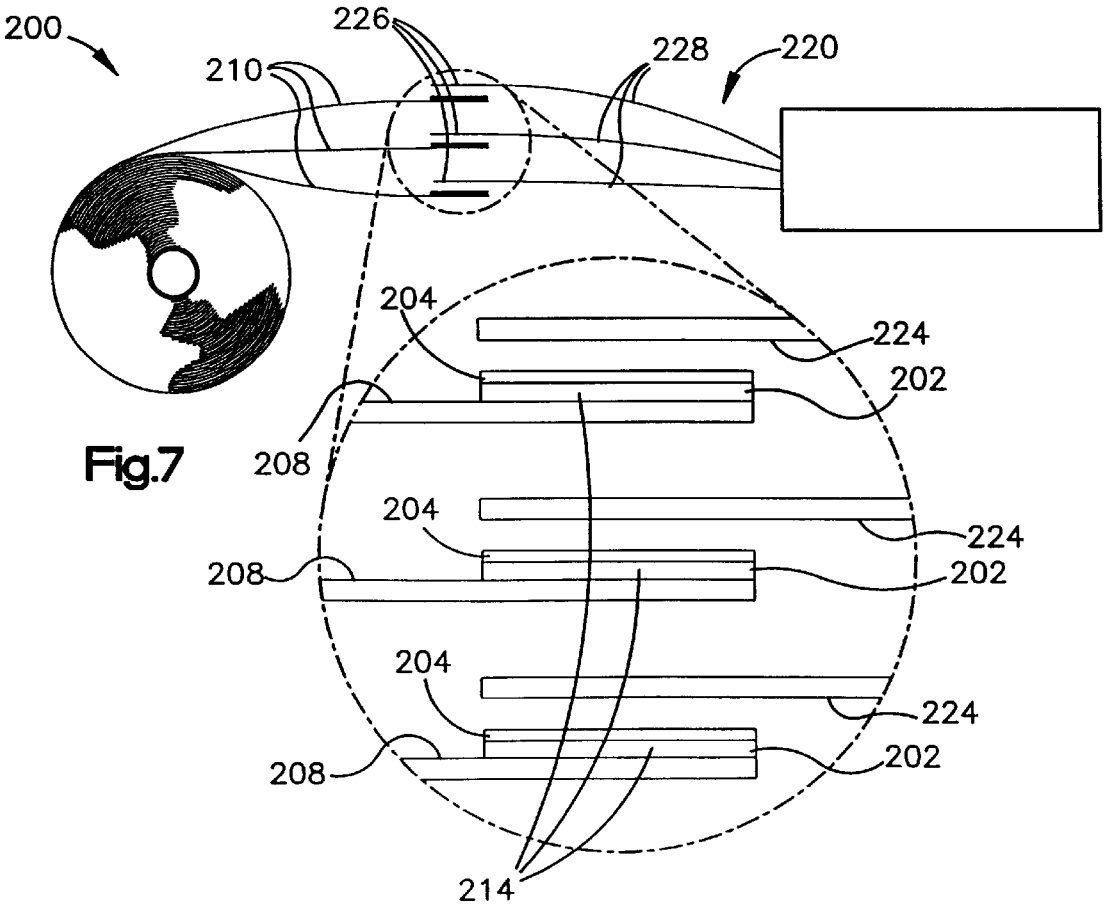
FIG. 7 is a side elevational view of a succeeding supply of stock material and an almost spent supply of stock material in accordance with an embodiment of the present invention.
Figure 8:
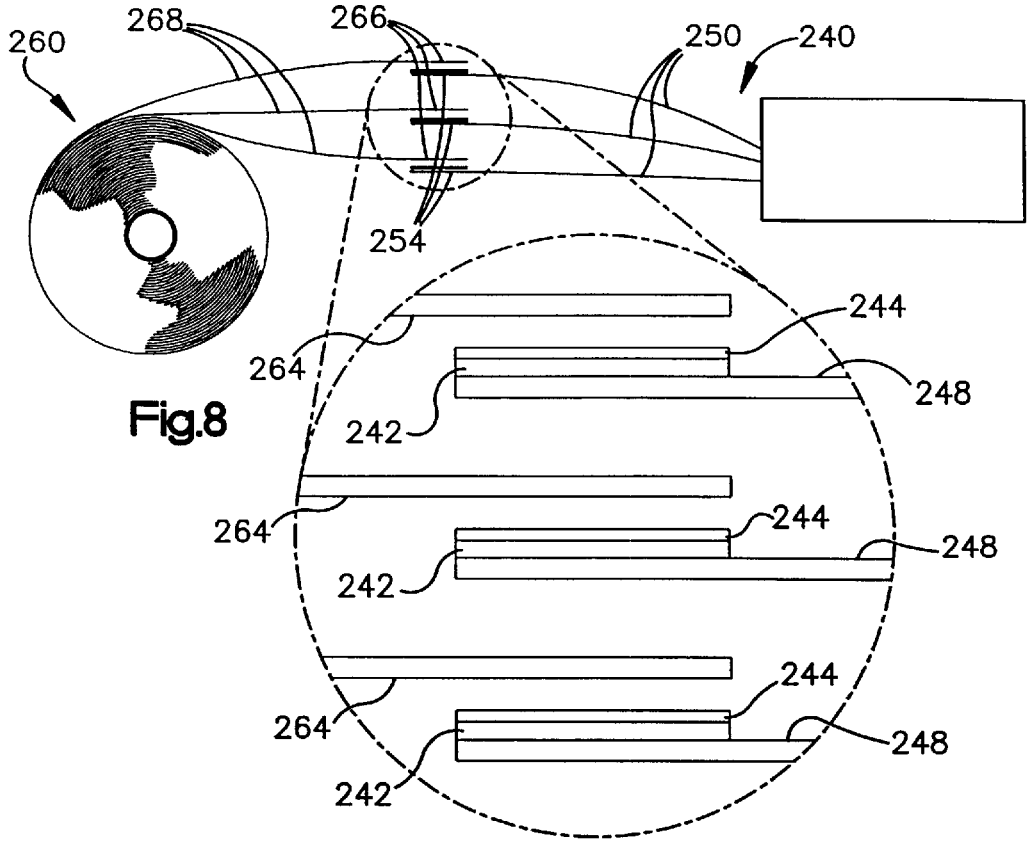
FIG. 8 is a side elevational view of a succeeding supply of stock material and an almost spent supply of stock material in accordance with an embodiment of the present invention.
Figure 8A:
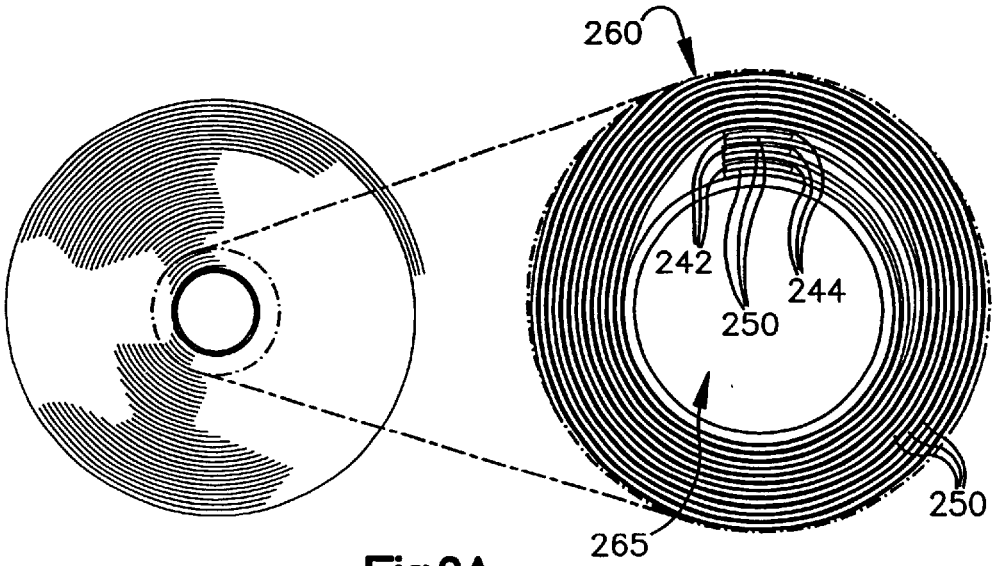
FIG. 8A is a side elevational view of the FIG. 8 succeeding supply of stock material illustrating the manner by which plies thereof overlap.
Figure 9:
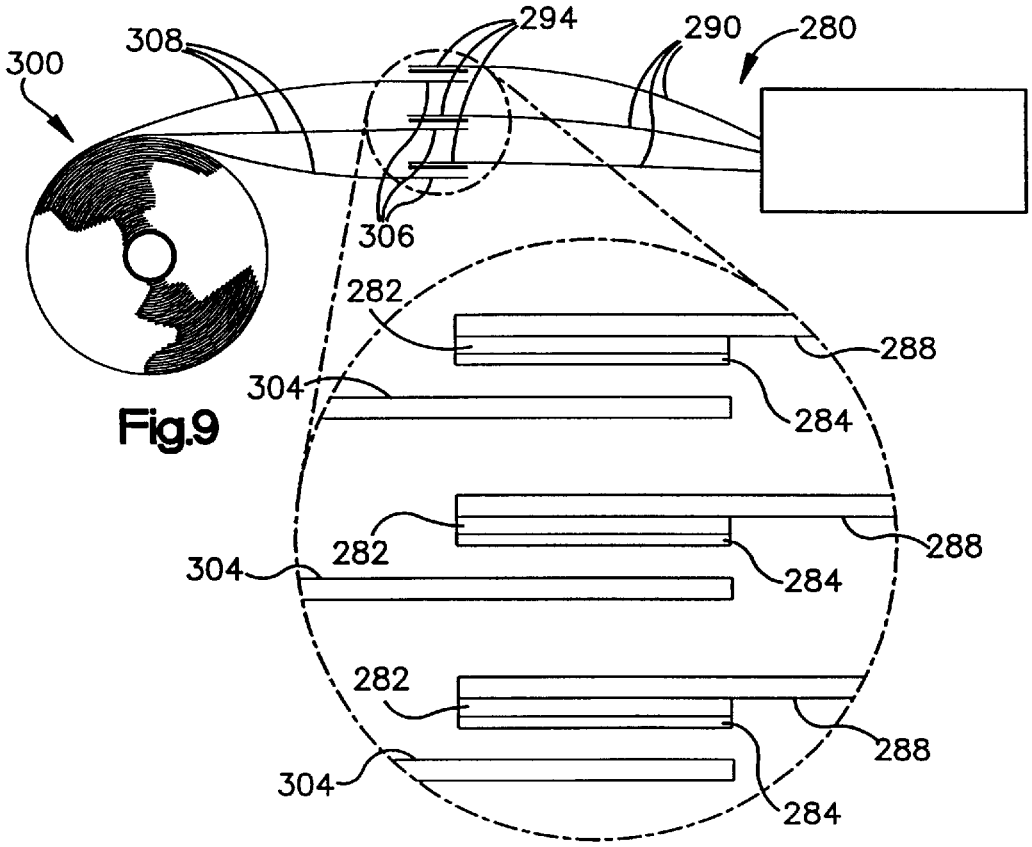
FIG. 9 is a side elevational view of a succeeding supply of stock material and an almost spent supply of stock material in accordance with an embodiment of the present invention.

FIGS. 7–9 show other embodiments of a supply of stock material. In FIG. 7, a next or succeeding supply of stock material 200 includes an adhesive layer 202 and liner 204 on the top or outer surface 208 of each ply 210 at the leading end 214 thereof. To splice the succeeding supply of stock material 200 to the almost spent supply of stock material 220, the liners 204 are released from the adhesive layers 202 of the respective plies 210 of the succeeding supply of stock material 200 and applied, such as by manually pressing same, to the inner surface or undersides 224 of the trailing ends 226 of the plies 228 of the almost spent supply of stock material 220. In FIG. 8, an almost spent supply of stock material 240 includes an adhesive layer 242 and liner 244 on the outer side 248 of each ply 250 at the trailing end 254 thereof. To splice the succeeding supply of stock material 260 to the almost spent supply of stock material 240, the liners 244 are released from the adhesive layers 242 of the respective plies 250 of the almost spent supply of stock material 240 and applied to the inner surface or undersides 264 of the leading ends 266 of the plies 268 of the succeeding supply of stock material 260. As is shown in FIG. 8A, the trailing ends 254 of the supply of stock material 240, as well as the adhesive layers 242 and liners 244 thereon, are stacked one atop of the other in the innermost portion 265 of the wound roll of stock material 240. In FIG. 9, an almost spent supply of stock material 280 includes an adhesive layer 282 and liner 284 on the inner surface or underside 288 of each ply 290 at the trailing end 294 thereof. To splice the succeeding supply of stock material 300 to the almost spent supply of stock material 280, the liners 284 are released from the adhesive layers 282 of the respective plies 290 of the almost spent supply of stock material 280 and applied to the outer surfaces or top sides 304 of the trailing ends 306 of the plies 308 of the almost spent supply of stock material 280.

Figure 6A:
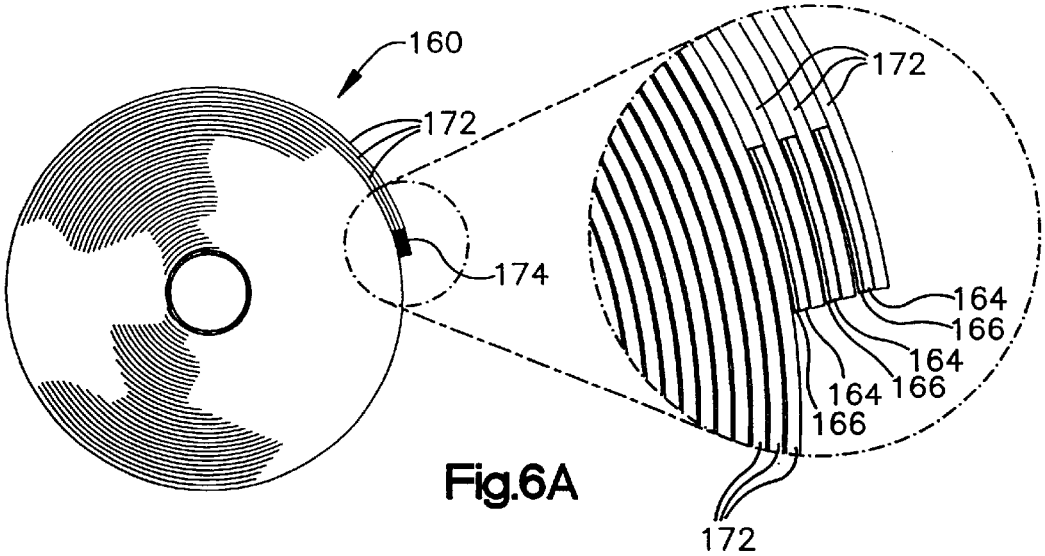
FIG. 6A is a side elevational view of the FIG. 6 succeeding supply of stock material illustrating the manner by which plies thereof overlap.

In the embodiments of FIGS. 6–9, the trailing and leading ends of the plies are stacked one atop of the other and the respective trailing and leading edges thereof are aligned with one another. In addition, the pressure sensitive adhesive layers and the liners covering the adhesive layers are stacked one atop of the other. In FIG. 6A, the overlap is at the leading end 174 (i.e., at the outside diameter) of the supply of stock material 160 and in FIG. 8A, the overlap is at the trailing end 254 (i.e., at the innermost portion 265) of the supply of stock material 240.

Figure 10:
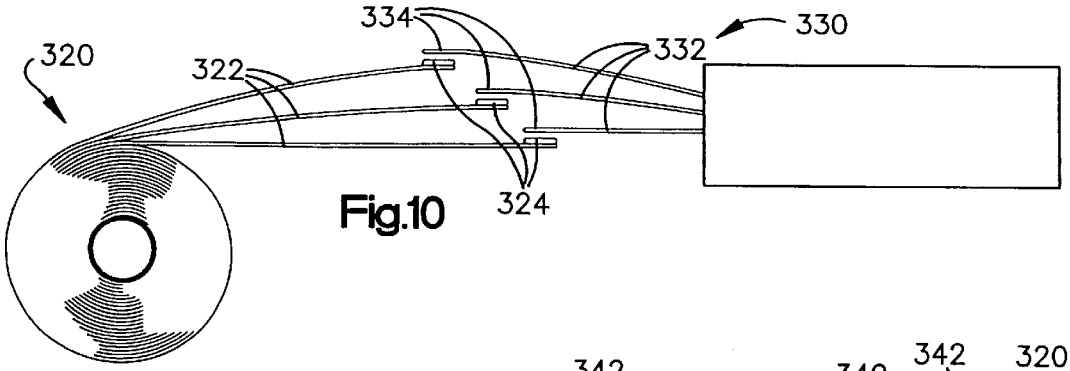
FIG. 10 is a side elevational view of a succeeding supply of stock material and an almost spent supply of stock material in accordance with an embodiment of the present invention.
Figure 10A:
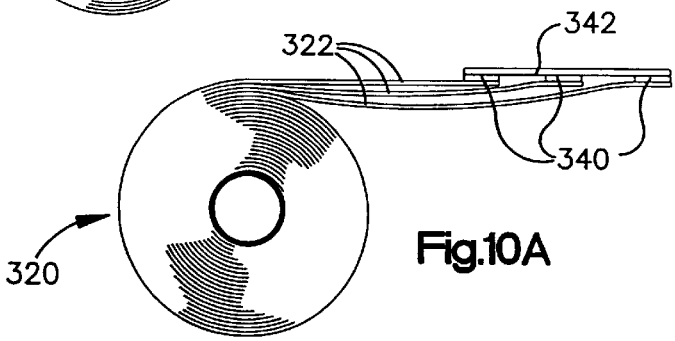
FIG. 10A is a side elevational view of the succeeding supply of stock material of FIG. 10, showing a single liner covering three adhesive layer portions.
Figure 10B:
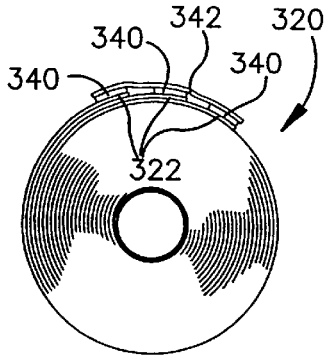
FIG. 10B is a side elevational view of the FIG. 10A succeeding supply of stock material illustrating the manner by which plies thereof overlap.
Figure 10C:
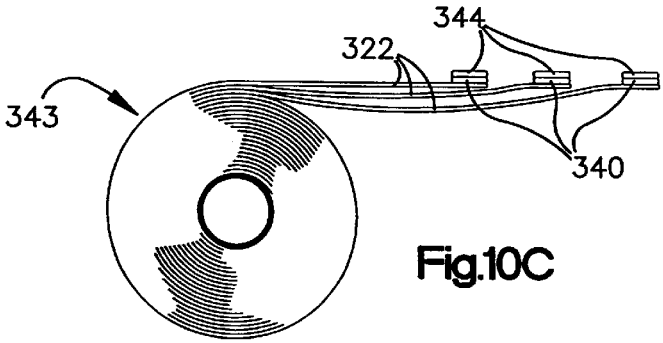
FIG. 10C is a side elevational view of the succeeding supply of stock material of FIG. 10, showing multiple liners covering respective adhesive layer portions.
Figure 10D:
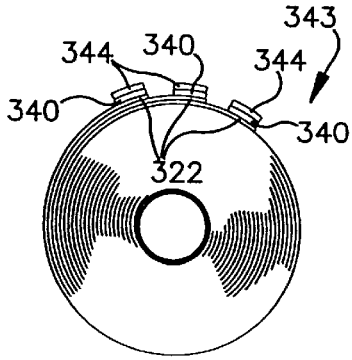
FIG. 10D is a side elevational view of the FIG. 10C succeeding supply of stock material illustrating the manner by which plies thereof overlap.

FIGS. 10–10B and 11–11B show other embodiments of a supply of stock material, the plies of which are offset from one another. More particularly, in FIG. 10, there is shown a succeeding supply of stock material 320 having three plies of sheet material 322, the leading ends 324 of which are longitudinally offset from one another, and an almost spent supply of stock material 330 having three plies of sheet material 332, the trailing ends 334 of which are longitudinally offset from one another substantially the same amount as that of the leading ends 324 of the plies 322 of the succeeding supply of stock material 320. As shown in FIG. 10A, the pressure sensitive adhesive layers 340 on the respective plies 322 of the succeeding supply of stock material 320 are preferably covered with a single liner 342 so that releasing the liner 342 exposes all three adhesive layers 340 on the respective plies 322 simultaneously. Also, the adhesive layers 340 are longitudinally spaced from one another so that they do not overlap with one another. As is seen in FIG. 10B, the adhesive layers 340 do not overlap when the stock material 320 is in its wound state, unlike the supply of stock material 160 shown in FIG. 6A. Also, although a single release liner 342 is preferred, it is not mandatory. For example, for the supply of stock material 343 of FIGS. 10C and 10D, wherein like reference numerals correspond to like features, multiple release liners 344 are used to cover the respective pressure sensitive adhesive layers 340.

Figure 11:
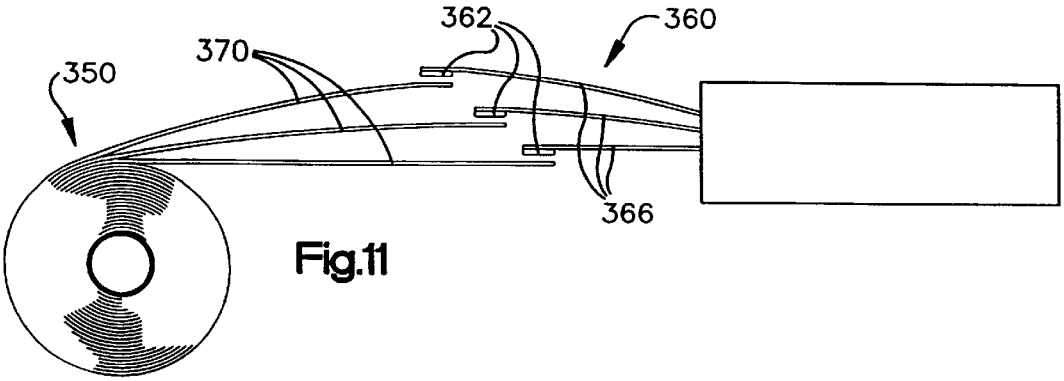
FIG. 11 is a side elevational view of a succeeding supply of stock material and an almost spent supply of stock material in accordance with an embodiment of the present invention.
Figure 11A:
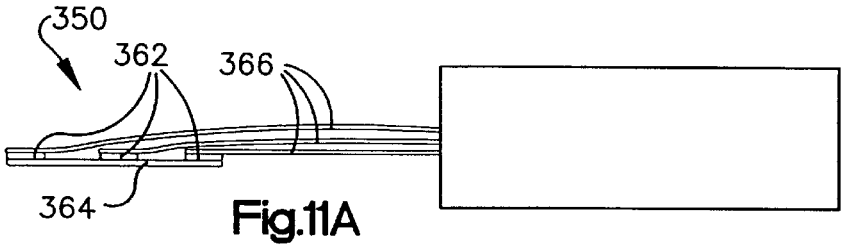
FIG. 11A is a side elevational view of the almost spent supply of stock material of FIG. 11, showing a single liner covering three adhesive layer portions.
Figure 11C:
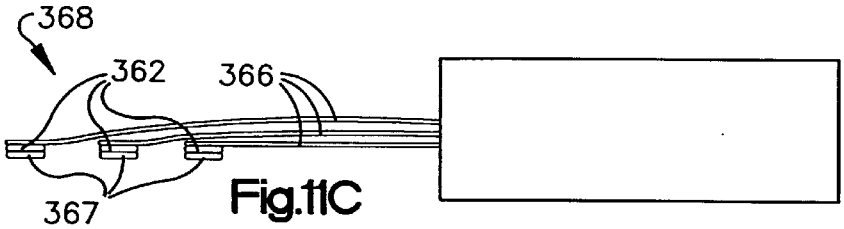
FIG. 11C is a side elevational view of the almost spent supply of stock material of FIG. 11, showing multiple liners covering respective adhesive layer portions.
Figure 11B:
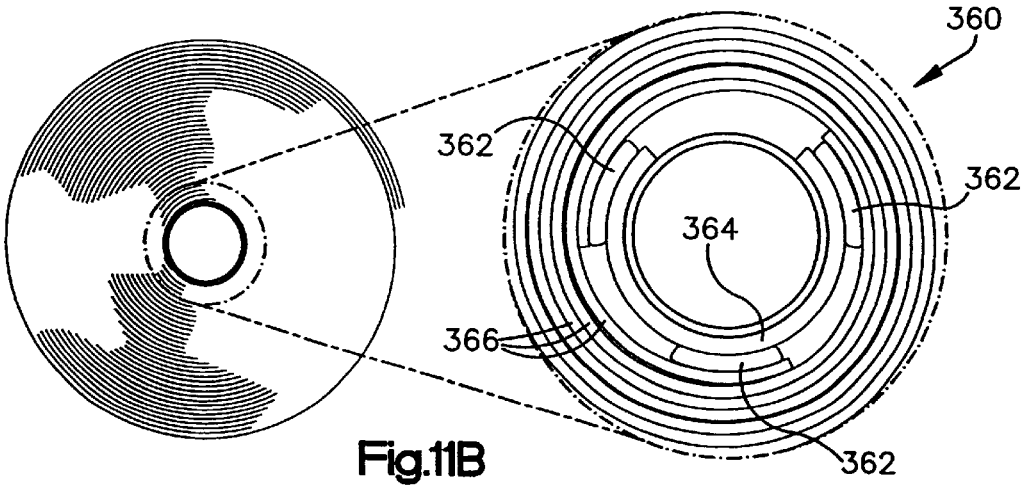
FIG. 11B is a side elevational view of the FIG. 11A almost spent supply of stock material illustrating the manner by which plies thereof overlap.
Figure 11D:
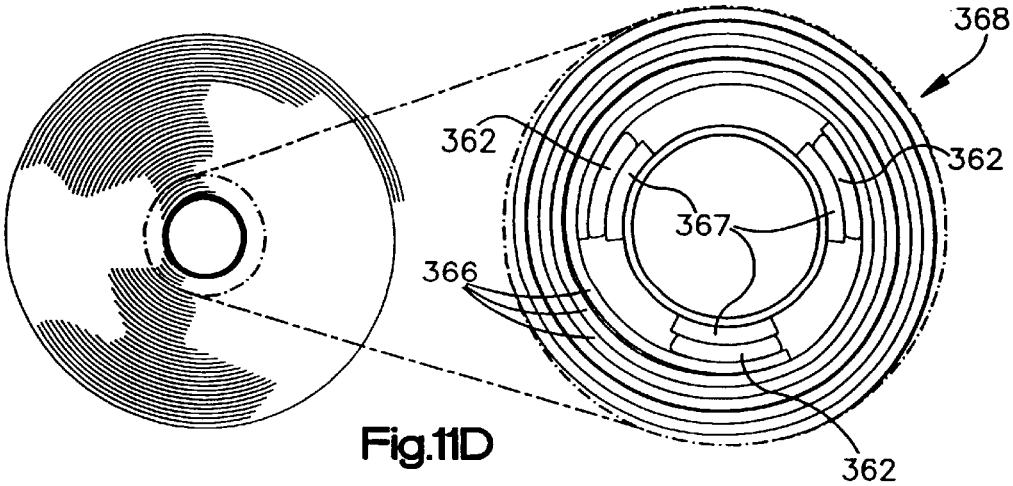
FIG. 11D is a side elevational view of the FIG. 11C almost spent supply of stock material illustrating the manner by which plies thereof overlap.

The succeeding supply of stock material 350 and almost spent supply of stock material 360 shown in FIGS. 11–11B are substantially similar to those shown in FIGS. 10–10B except that the pressure sensitive adhesive layers 362 (and single release liner 364) are on the respective plies 366 of the almost spent supply of stock material 360 rather than the plies 370 of the succeeding supply of stock material 350. As is seen in FIG. 11B, the adhesive layers 362 do not overlap when the stock material 360 is in its wound state, unlike the supply of stock material 240 shown in FIG. 8A. Also, multiple liners 367 may be used to cover the respective pressure sensitive adhesive layers 362, as is shown for the supply of stock material 368 of FIGS. 11C and 11D, wherein like reference numerals correspond to like features.

Figure 12:
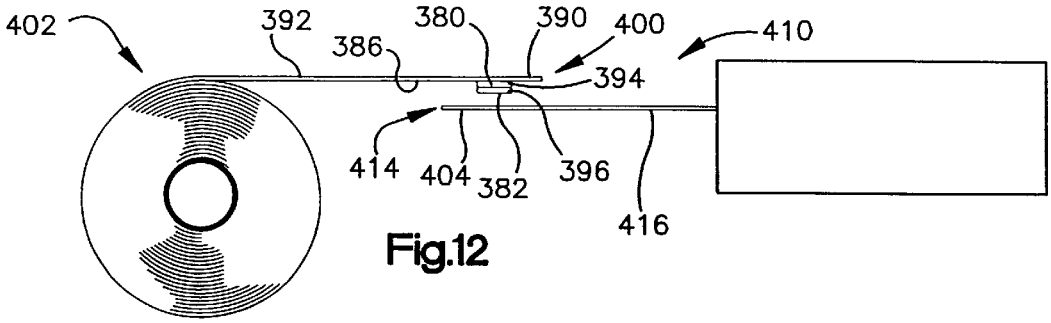
FIG. 12 is a side elevational view of a lap splice between a succeeding supply of stock material and an almost spent supply of stock material in accordance with an embodiment of the present invention.
Figure 13:
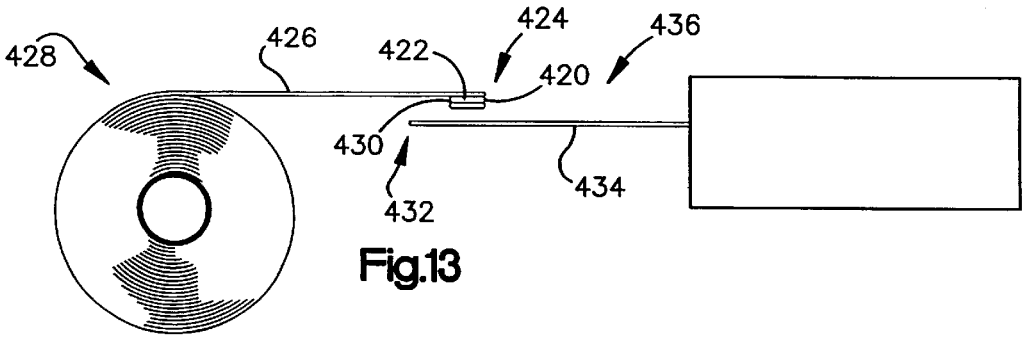
FIG. 13 is a side elevational view of a lap splice between a succeeding supply of stock material and an almost spent supply of stock material in accordance with an embodiment of the present invention.
Figure 14:
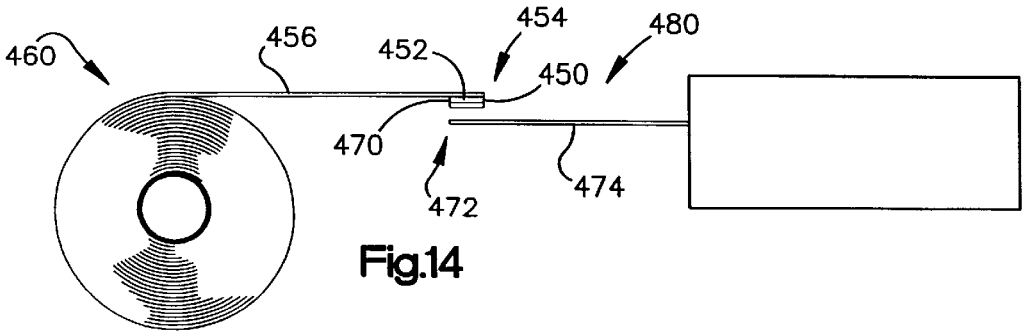
FIG. 14 is a side elevational view of a lap splice between a succeeding supply of stock material and an almost spent supply of stock material in accordance with an embodiment of the present invention.

Referring now to FIGS. 12–14, there are shown different types of lap splices in accordance with the invention. In FIG. 12, the pressure sensitive adhesive layer 380 and liner 382 covering the adhesive layer 380 are on the inner or underside 386 of the leading end 390 of the ply of sheet material 392. The leading edges 394 and 396 of the adhesive layer 380 and release liner 382 are longitudinally offset from the edge 400 of the ply of sheet material 392. The leading end 390 of the supply of stock material 402 is spliced to a trailing end 404 of an almost spent supply of stock material 410 such that the adhesive layer 380 is longitudinally offset from the trailing edge 414 of the ply of sheet material 416. Thus, the edges 400 and 414 of the plies 392 and 416 extend longitudinally beyond the adhesive layer 380 when the succeeding supply of stock material 402 is spliced to the almost spent supply of stock material 410. In FIG. 13, the leading edge 420 of the adhesive layer 422 is aligned with the leading edge 424 of the ply of sheet material 426 of the succeeding supply of stock material 428 and the trailing edge 430 of the adhesive layer 422 is offset from the trailing edge 432 of the ply of sheet material 434 of the almost spent supply of stock material 436. FIG. 14 shows a lap splice similar to that of the embodiment of FIG. 13, except that the trailing edge 460 of the adhesive layer 462 is aligned with the trailing edge 464 of the ply of sheet material 466 of the almost spent supply of stock material 468.

Each of the lap splices of the above described embodiments have their associated advantages. For example, in the FIG. 12 embodiment production time is saved since the lap splice does not require an operator to align the edges of the adhesive layer with the leading or trailing ends of the stock material. However, the lap splices of the FIG. 13 and FIG. 14 embodiments are advantageous because aligning the adhesive layer with the leading end of the stock material (FIGS. 13 and 14) or with the trailing end of the stock material (FIG. 14) ensures that there are no unadhered overlapping portions of stock material which may be snagged or caught on an internal component of the conversion machine 10 as the overlapped stock material is advanced through the conversion machine 10. In view of the foregoing, it will be appreciated that determining the type of splice to be used is based on factors such as production costs, the type of conversion machine, the type of stock material and/or the type of adhesive.

Figure 15:
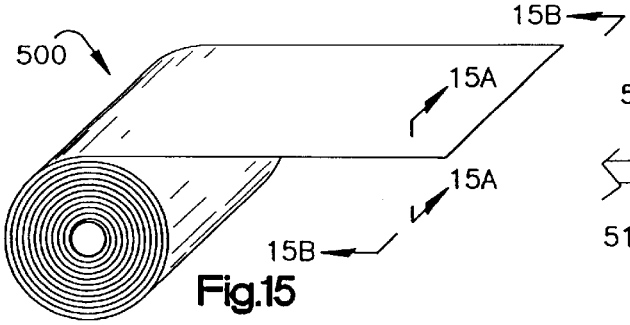
FIG. 15 is a perspective view of a supply of stock material in accordance with an embodiment of the present invention.
Figure 15A:
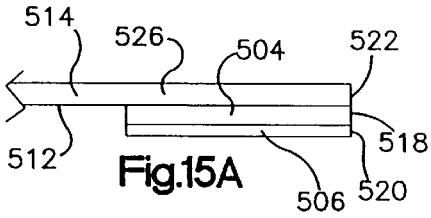
FIG. 15A is a side view of the FIG. 15 supply of stock material taken along the line 15A—15A in FIG. 15.
Figure 15B:
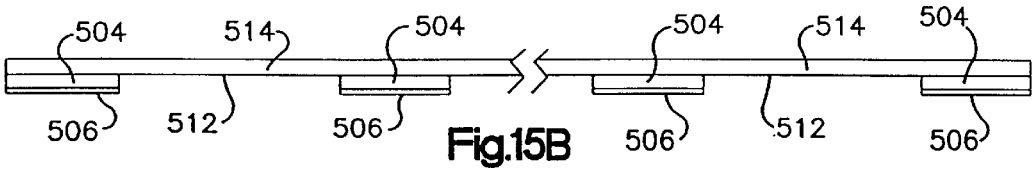
FIG. 15B is an end view of the FIG. 15 supply of stock material taken along the line 15B—15B in FIG. 15.

FIGS. 15–15B show another embodiment of a supply of stock material 500. Here, the supply of stock material 500 includes multiple transversely spaced (FIG. 15B) portions of pressure sensitive adhesive layer 504 and respective release liners 506 covering the adhesive layer portions 504, as distinguished from a continuous-width layer. As is shown in FIG. 15A, the adhesive layer portions 504 and release liners 506 are on the inner surface or underside 512 of the ply of sheet material 514, and leading edges 518 and 520 of the respective adhesive layer portions 504 and release liners 506 are aligned with a leading edge 522 of the ply of sheet material 514. In this embodiment, to splice the leading end 526 of the supply of stock material 500 to the trailing end of an almost spent supply of stock material (not shown), each release liner portion 506 is individually released from its respective pressure sensitive adhesive layer portion 504. It will be appreciated that such an embodiment requires less pressure sensitive adhesive material than, for example, the embodiment of FIGS. 4–4B, wherein the adhesive layer and release liner extend transversely across the entire width of the ply of sheet material.

Figure 16:
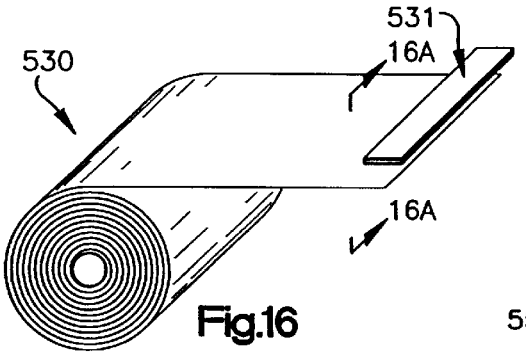
FIG. 16 is a perspective view of a supply of stock material in accordance with an embodiment of the present invention.
Figure 16A:
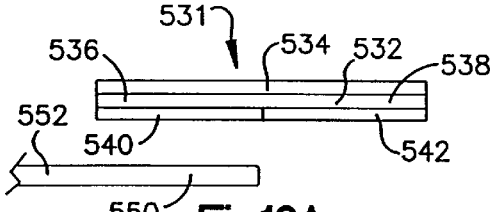
FIG. 16A is a side view of the FIG. 16 supply of stock material taken along the line 16A—16A in FIG. 16, showing a strip of adhesive and carrier and a leading end of a ply of stock material.
Figure 16B:
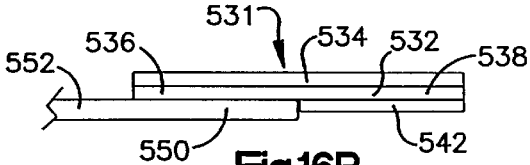
FIG. 16B is a side view of the FIG. 16 supply of stock material taken along the line 16A—16A in FIG. 16, showing a trailing end of the strip of adhesive applied on a leading end of a ply of stock material.
Figure 16C:
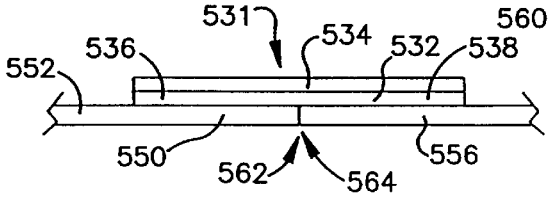
FIG. 16C is a side view of the FIG. 16 supply of stock material taken along the line 16A—16A in FIG. 16, showing a leading end of the strip of adhesive applied on a trailing end of a ply of stock material.

In FIGS. 16–16C, there is shown still another embodiment of a supply of stock material 530 in accordance with the invention. The supply of stock material 530 includes a transverse strip 531 including a pressure sensitive adhesive layer 532 and a backing or carrier 534 (such as Kraft paper) on which the adhesive layer 532 is provided. The adhesive layer 532 has a trailing end 536 and a leading end 538. A pair of adjacent transverse release liners 540 and 542 (i.e., a trailing end liner 540 and a leading end liner 542) cover the respective trailing end and leading end adhesive layer portions 536 and 538 of the transverse strip 531. As is seen in FIGS. 16A and 16B, the trailing end release liner 540 is released to bond the trailing end 536 of the adhesive layer 532 to a leading end 550 of a ply of sheet material 552 of the succeeding supply of stock material 530. The leading end release liner 542 remains intact until the succeeding supply of stock material 530 is ready for splicing to an almost spent supply of stock material. FIG. 16C shows the leading end liner 542 released from the leading end 538 of the adhesive layer 532 and the leading end 538 of the adhesive layer 532 bonded to the trailing end 556 of a ply of sheet material 560 thereby to splice the plies 552 and 560 together. The splice shown in FIG. 16C is a butt splice; that is, the leading edge 562 of the ply of sheet material 552 abuts the trailing edge 564 of the ply of sheet material 560.

It will be appreciated that an existing succeeding supply of stock material may be retrofitted with the strip 531 so that the supply of stock material is in a ready-to-splice form. Alternatively, the strip 531 may be bonded to the leading end of the stock material in the process of manufacturing the supply of stock material.

Figure 17:
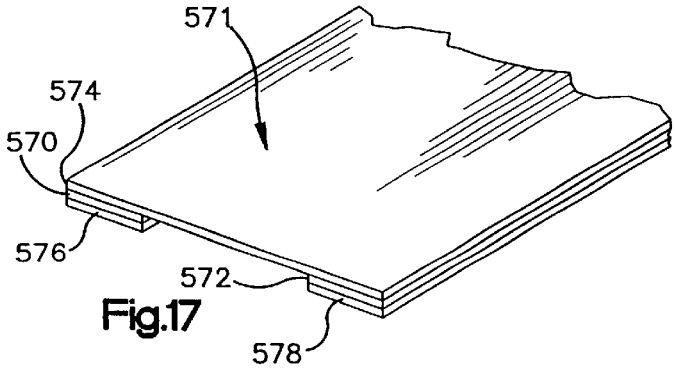
FIG. 17 is a perspective view of a strip of adhesive for use in a supply of stock material in accordance with an embodiment of the present invention.

FIG. 17 shows an alternative strip 571 wherein there are a pair longitudinally spaced pressure sensitive adhesive layers 570 and 572 provided on a carrier 574. Here, the pair of adjacent transverse release liners 576 and 578 which cover the respective pressure sensitive adhesive layers 570 and 572 are longitudinally spaced although a single release liner would also be suitable.

Figure 18:
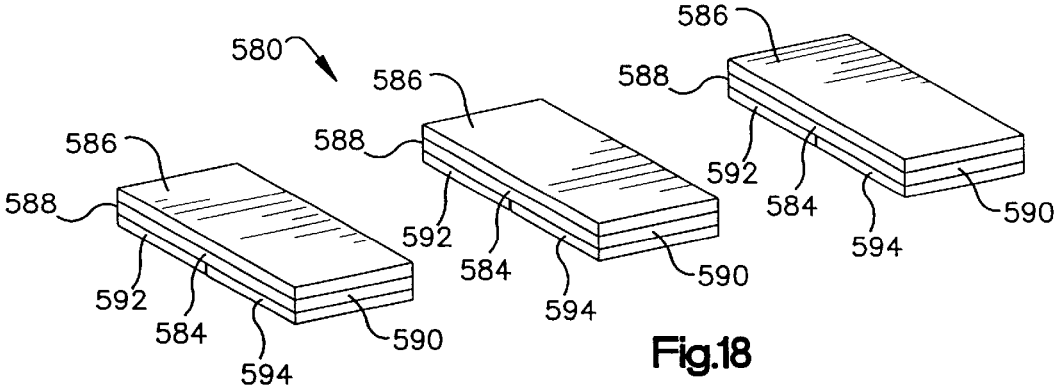
FIG. 18 is a perspective view of multiple strips of adhesive layer for use in a supply of stock material in accordance with an embodiment of the present invention.
Figure 18A:
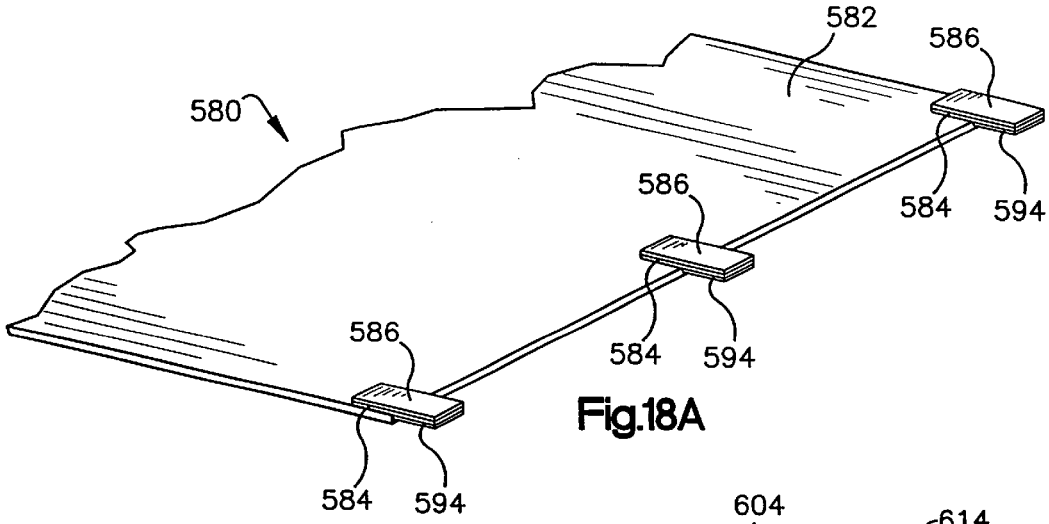
FIG. 18A is a perspective view of a leading end of a supply of stock material, the leading end having thereon the multiple strips of adhesive layer of FIG. 18.

Referring now to FIGS. 18 and 18A, there is shown another embodiment of a supply of stock material 580 and, more particularly, the leading end 582 of the supply of stock material 580. The supply of stock material 580 is similar to the supply of stock material 530 in FIGS. 16–16C except that, instead of a continuous-width transverse strip, there are multiple transversely spaced strips of pressure sensitive adhesive layers 584 on respective carriers 586. Each adhesive strip 584 has a trailing end 588 and a leading end 590. Adjacent release liners 592 and 594 (i.e., a trailing end release liner 592 and a leading end release liner 594) cover the respective trailing end and leading end adhesive layer portions 588 and 590 of the respective transversely spaced strips 584. The supply of stock material 580 shown in FIGS. 18 and 18A requires less pressure sensitive adhesive material than, for example, the supply of stock material 530 shown in FIGS. 16–16C.

Figure 19A:
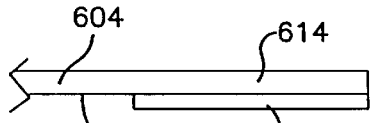
FIG. 19A is a side view of the FIG. 19 supply of stock material taken along the line 19A—19A in FIG. 19.
Figure 19:
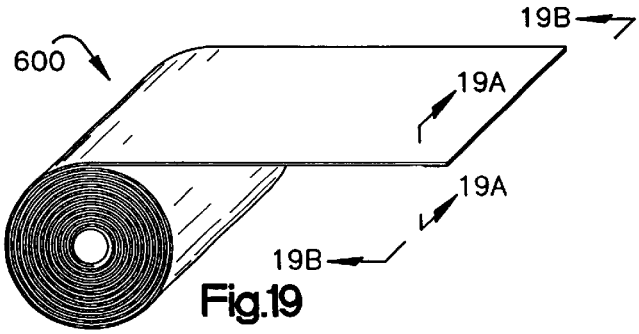
FIG. 19 is a perspective view of a supply of stock material in accordance with an embodiment of the present invention.
Figure 19C:
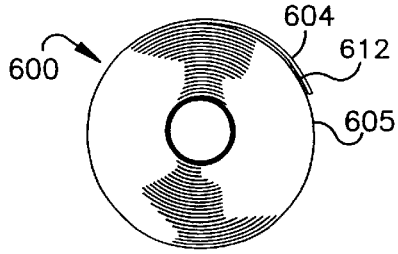
FIG. 19C is a side elevational view of the FIG. 19 supply of stock material illustrating the manner by which the sheet material thereof overlaps upon itself.
Figure 19B:
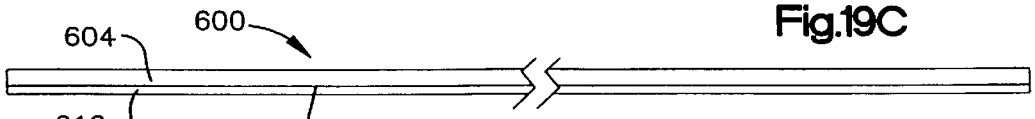
FIG. 19B is an end view of the FIG. 19 supply of stock material taken along the line 19B—19B in FIG. 19.

FIGS. 19–19C show an embodiment of a supply of stock material 600 similar to the embodiment shown in FIGS. 4–4B except that the release liner is provided by an adjacent layer of sheet stock material. Here, the supply of stock material 600 includes a single ply of sheet material 604 with a pressure sensitive adhesive layer 612 provided on a leading end 614 thereof. The adhesive layer 612 is permanently attached on the underside 618 (FIGS. 19A and 19B) of the sheet material 604. The adhesive layer 612 comprises a reduced strength adhesive which herein means a pressure sensitive adhesive that enables a release liner to be cleanly and easily removed from the adhesive layer to expose the adhesive layer, which exposed adhesive layer can then be removably adhered to the sheet stock material. This permits the sheet stock material 604 to be wound, or stacked, on top of itself, i.e., to the underlying adjacent layer 605 of sheet stock material (FIG. 19C). In addition, this permits the sheet stock material with the adhesive layer to be repositioned when splicing. The reduced strength adhesive also provides sufficient adhesive holding power and shear strength between the layers of sheet stock material when spliced to maintain the leading and trailing ends spliced together when subjected to a longitudinal pulling force. An exemplary adhesive is the adhesive used for Highland™ brand removable notes manufactured by 3M.

It is noted that the adhesive layer 612 may alternatively comprise an adhesive having a holding power and shear strength that provides a permanent bond (i.e., not removable) between the layers of sheet stock material when spliced. In this case, the adjacent layer of sheet stock material, or at least the portion of the adjacent layer of stock material which the adhesive layer 612 overlaps, will require a surface treatment such as by application of a coating of a material which would enable clean and easy removal of the adhesive layer 612 from the overlapped portion; in other words, to enable the overlapped portion to operate as the release liner.

To splice the succeeding supply of stock material 600 to an almost spent supply of stock material (not shown), the leading end 614 of the ply of sheet material 604, along with the adhesive layer 612 thereon, is removed (i.e., unwound) from the supply of stock material 600 and then spliced to, or more particularly adhered to, the outer, or top, surface of the trailing end of a ply of the almost spent supply of stock material. Because the adhesive layer 612 has a reduced strength adhesive, the leading end 614 of the ply of sheet material 604 may be repositioned, as desired, to obtain the appropriate alignment between the leading end 614 of the ply of sheet material 604 of the succeeding supply of stock material 600 with the trailing end of the ply of the almost spent supply of stock material. The adhesive layer 612 has sufficient shear strength and adhesive holding power to maintain the splice (i.e., the adhesive bond) of the leading end 614 of the succeeding supply of stock material 600 to the trailing end of the almost spent supply of stock material when the stock material is advanced through the conversion machine 10.

It will be appreciated that a reduced strength adhesive layer and an adjacent layer of sheet stock material as a release liner (as described with reference to FIGS. 19–19C) may be applicable in other of the afore described embodiments. Thus, for example, a reduced strength adhesive may be used on a trailing end of an almost spent supply of stock material with the adjacent stock material serving as the release liner (FIGS. 5–5A), in a supply of stock material comprised of multiple plies and provided on either the outer or inner surface of either the leading end or trailing end of the stock material (FIGS. 6–9), in a longitudinally offset manner (FIGS. 10–11D), in an offset or aligned lap splice (FIGS. 12–14), or in the form of multiple transversely spaced adhesive portions (FIGS. 15–15B). In each of the foregoing, the adjacent sheet of stock material or another portion of the stock supply (such as, in the case of a stock roll, a core tube to which the stock material thereof is wound) serves as the release liner.

Figure 20:
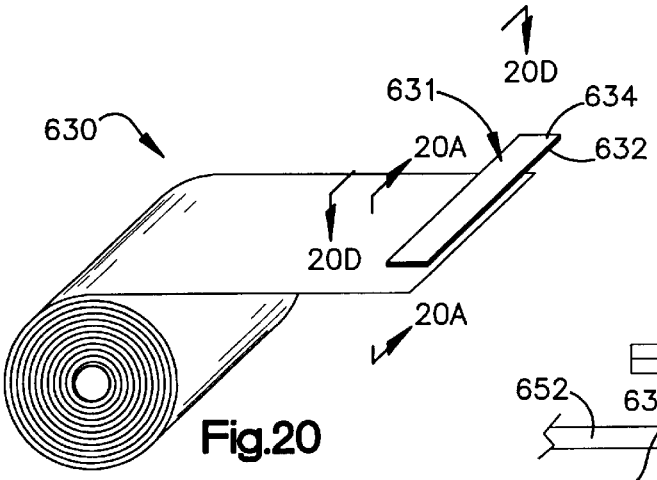
FIG. 20 is a perspective view of a supply of stock material in accordance with an embodiment of the present invention.
Figure 20A:
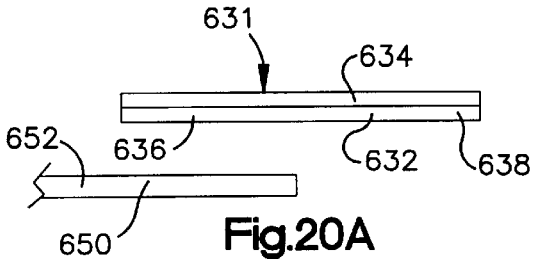
FIG. 20A is a side view of the FIG. 20 supply of stock material taken along the line 20A—20A in FIG. 20, showing a strip of adhesive and carrier and a leading end of a ply of stock material.
Figure 20B:
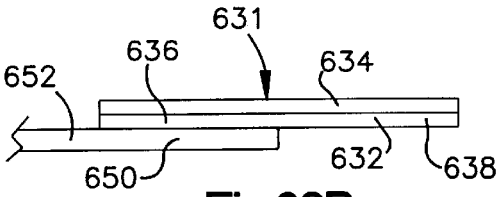
FIG. 20B is a side view of the FIG. 20 supply of stock material taken along the line 20A—20A in FIG. 20, showing a trailing end of the strip of adhesive applied on a leading end of a ply of stock material.
Figure 20C:
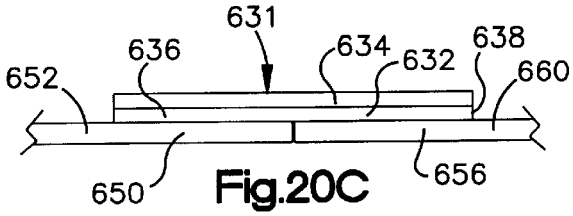
FIG. 20C is a side view of the FIG. 20 supply of stock material taken along the line 20A—20A in FIG. 20, showing a leading end of the strip of adhesive applied on a trailing end of a ply of stock material.
Figure 20D:
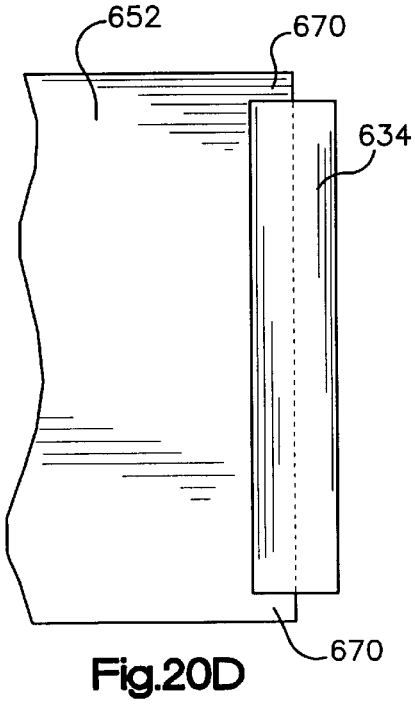
FIG. 20D is a broken top plan view of the FIG. 20 supply of stock material taken along the line 20D—20D in FIG. 20, showing a leading end of the strip of adhesive applied on a trailing end of a ply of stock material.

Referring to FIGS. 20–20D, it will also be appreciated that the adhesive layer 612 described with reference to FIGS. 19–19C may be used in the form of a transverse strip of adhesive provided on a carrier in a manner similar to that described above with reference to FIGS. 16–16C. FIGS. 20–20D show an embodiment of a supply of stock material 630 in accordance with the invention. The supply of stock material 630 includes a transverse strip 631 of pressure sensitive adhesive layer 632 provided on a carrier 634 such as Kraft paper. The adhesive layer 632 has a trailing end 636 and a leading end 638, both of which are exposed. As is seen in FIGS. 20A and 20B, the trailing end 636 of the adhesive layer 632 is bonded to a leading end 650 of a ply of sheet material 652 of the succeeding supply of stock material 630. The sheet material 652, along with the adhesive layer 632, is then wound onto itself to form the succeeding supply roll of stock material 630 (not shown). The layer of sheet stock material underlying or adjacent the adhesive layer 632 serves as the release liner, enabling the clean and easy removal of the adhesive layer 632 therefrom. When the succeeding supply of stock material 630 is ready for splicing to an almost spent supply of stock material, the leading end 650 of the ply of sheet material 652, along with the leading end 638 of the adhesive layer 632, is removed (i.e., unwound) from the supply of stock material 630, thereby separating the leading end 638 from the adjacent layer of sheet stock material serving as the release liner, and then bonded to the trailing end 656 of a ply of sheet material 660 thereby to splice the plies 652 and 660 together (FIG. 20C). It will be recognized that the supply of stock material 630 in FIG. 20 is substantially similar to the supply of stock material 530 in FIG. 16, except that for the supply of stock material 530 in FIG. 16 the release liner 540, 542 is provided by a liner or covering separate from the sheet stock material, and for the supply of stock material 630 in FIG. 20 the release liner is provided by an adjacent layer of the sheet stock material.

Referring now to FIG. 20D, the strip 631 of adhesive layer 632 and carrier 634 are sized slightly less in width than that of the ply of sheet material 652. This difference in width provides a lateral tolerance surface area 670 on the lateral sides of the sheet material 652 within which the strip of adhesive 632 may be applied. The lateral tolerance surface area 670 provides an operator with a greater target area within which to apply the adhesive layer 632 and carrier 634 to the sheet material 652.

Referring again to FIGS. 20A–20C, it is noted that the leading end 638 and trailing end 636 portions of the adhesive layer 632 may have, if desired, different strength adhesives. For example, the trailing end adhesive layer 636 may comprise a permanent bond type adhesive (i.e., not removable) while the leading end adhesive layer 638 comprises a reduced strength adhesive as defined herein above. In this way, the permanent bond type of adhesive of the trailing end adhesive layer 636 ensures that the trailing end adhesive layer 636 portion of the adhesive layer 632 remains intact with the sheet material 652.

As was mentioned above with regard to the strip of adhesive described with reference to FIGS. 16–16C, it will be appreciated that an existing succeeding supply of stock material may be retrofitted with the strip 631 of pressure sensitive adhesive layer 632 and carrier 634 so that the supply of stock material is in a ready-to-splice form. Alternatively, the strip 631 of pressure sensitive adhesive 632 and carrier 634 may be bonded to the leading end of the stock material in the process of manufacturing the supply of stock material.

Figure 21:
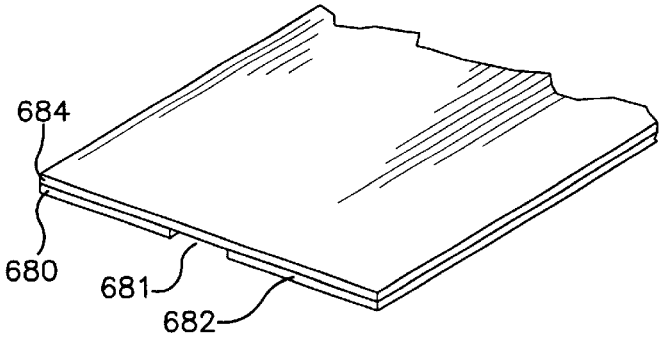
FIG. 21 is a perspective view of a strip of adhesive for use in a supply of stock material in accordance with an embodiment of the present invention.

FIG. 21 shows an alternative strip wherein there are a pair longitudinally spaced pressure sensitive adhesive layers 680 and 682 provided on a carrier 684. The longitudinal spacing 681 between the adhesive layers 680 and 682 provides an operator with a longitudinal tolerance within which the leading end of a succeeding supply of stock material and the trailing end of an almost spent supply of stock material are spliced. Thus, if the adhesive layer 680 is applied to a leading end of a stock supply, it is less likely that a portion thereof will overextend the edge of the leading end and undesirably stick to the stock material adjacent thereto when the leading end is wound into stock roll form. This is particularly useful if it is desired that the adhesive layers 680 and 682 have different strengths, for example, wherein the adhesive layer 680 is a permanent bond type adhesive and the adhesive layer 682 is a reduced strength adhesive. In this instance, the permanent bond type adhesive layer 680 ensures that the carrier is adhered to the leading end of the supply of stock material, and the reduced strength adhesive layer 682 permits easy repositioning.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A supply of sheet stock material for use in a cushioning conversion machine, comprising:

a multi-ply sheet stock material rolled or folded into a compact configuration, and each ply of the multi-ply sheet stock material having on a leading or trailing end thereof a pressure sensitive adhesive layer and a removable release liner covering the pressure sensitive adhesive layer.

2. A supply of sheet stock material as set forth in claim 1, wherein the removable release liner is formed by a next adjacent ply of the sheet stock material.

3. A supply of sheet stock material as set forth in claim 2, wherein said adjacent ply has on its surface facing the adhesive layer a surface treatment for permitting removal of the adhesive layer from the adjacent ply.

4. A supply of sheet stock material as set forth in claim 1, wherein the pressure sensitive adhesive layer has a plurality of adhesive portions spaced apart across the width of said ply.

5. A supply of sheet stock material as set forth in claim 1, wherein the pressure sensitive adhesive layer extends substantially across the width of said ply of sheet stock material.

6. A supply of sheet stock material as set forth in claim 1, wherein the sheet stock material is fan-folded into said compact configuration.

7. A supply of sheet stock material as set forth in claim 1, wherein the sheet stock material is rolled into said compact configuration.

8. A supply of sheet stock material as set forth in claim 1, wherein the pressure sensitive layers are are aligned with one another in a direction perpendicular to the longitudinal extent of the sheet stock material.

9. A supply of sheet stock material as set forth in claim 1, wherein trailing or leading edges of the plies of sheet stock material are longitudinally offset from one another, and the pressure sensitive adhesive layers are positioned within the longitudinal offsets.

10. A supply of sheet stock material as set forth in claim 1, wherein trailing or leading edges of the pressure sensitive adhesive layers are longitudinally offset from trailing or leading edges of adjacent plies.

11. A supply of sheet stock material as set forth in claim 1, wherein the pressure sensitive adhesive layer is formed by one side of a double-sided adhesive strip.

12. A supply of sheet stock material as set forth in claim 1, wherein the pressure sensitive adhesive layer includes a reduced strength adhesive.

13. A supply of sheet stock material for use in a cushioning conversion machine, comprising:

at least one ply of kraft paper rolled or folded into a compact configuration, each ply of kraft paper having on a leading or trailing end thereof a pressure sensitive adhesive layer and a removable release liner covering the pressure sensitive adhesive layer.

14. A supply of sheet stock material as set forth in claim 13, wherein the kraft paper is 30# kraft paper.

15. A supply of sheet stock material as set forth in claim 13, wherein the kraft paper is 50# kraft paper.

* * * * *